US009702572B2

(12) United States Patent
Lee et al.

(10) Patent No.: US 9,702,572 B2
(45) Date of Patent: Jul. 11, 2017

(54) SOLAR DEHUMIDIFYING AND COOLING SYSTEM

(71) Applicant: KOREA INSTITUTE OF SCIENCE AND TECHNOLOGY, Seoul (KR)

(72) Inventors: Dae Young Lee, Seoul (KR); Sung Chul Shin, Seoul (KR)

(73) Assignee: KOREA INSTITUTE OF SCIENCE AND TECHNOLOGY, Seoul (KR)

( * ) Notice: Subject to any disclaimer, the term of this patent is extended or adjusted under 35 U.S.C. 154(b) by 149 days.

(21) Appl. No.: 14/585,861

(22) Filed: Dec. 30, 2014

(65) Prior Publication Data

US 2015/0184873 A1 Jul. 2, 2015

(30) Foreign Application Priority Data

Dec. 31, 2013 (KR) ..... 10-2013-0169148

(51) Int. Cl.
*F24F 3/14* (2006.01)
*F24F 5/00* (2006.01)

(52) U.S. Cl.
CPC ..... *F24F 3/14* (2013.01); *F24F 5/0046* (2013.01); *F24F 2003/144* (2013.01); *F24F 2005/0064* (2013.01); *F24F 2203/10* (2013.01); *F24F 2203/1032* (2013.01)

(58) Field of Classification Search
CPC .... F24F 3/14; F24F 5/0046; F24F 2203/1032; F24F 2003/144; F24F 2203/10; F24F 2005/0064; F25B 27/007; F25B 15/00; F25B 35/00; F25B 39/00; F25B 15/14; F25B 2500/17; Y02B 10/20
USPC ..... 62/56, 235.1
See application file for complete search history.

(56) References Cited

U.S. PATENT DOCUMENTS

| | | | | | |
|---|---|---|---|---|---|
| 4,488,408 | A * | 12/1984 | Kajitsuka | F24F 3/1423 | 62/113 |
| 4,786,301 | A * | 11/1988 | Rhodes | F24F 3/1411 | 62/271 |
| 4,898,152 | A * | 2/1990 | Kahl | F24D 17/0021 | 122/381 |
| 5,894,836 | A * | 4/1999 | Wu | F24F 5/0046 | 126/617 |
| 7,601,206 | B2 * | 10/2009 | Call | F24F 3/1423 | 95/113 |
| 8,511,296 | B2 * | 8/2013 | Sweet | F24D 11/003 | 126/572 |
| 2007/0079623 | A1 * | 4/2007 | Inaba | F24F 3/1423 | 62/260 |

(Continued)

FOREIGN PATENT DOCUMENTS

| | | | |
|---|---|---|---|
| JP | 2003-148786 | A | 5/2003 |
| KR | 1020120059811 | A | 6/2012 |
| KR | 1020130142259 | A | 12/2013 |

OTHER PUBLICATIONS

Koren Office Action dated Jun. 4, 2015; Appln. No. 10-2013-0169148.

*Primary Examiner* — Mohammad M Ali
(74) *Attorney, Agent, or Firm* — Ladas & Parry LLP; Loren K. Thompson

(57) ABSTRACT

Provided is a solar dehumidifying and cooling system including a solar hot water device that produces hot water by using solar heat and a dehumidifying and cooling device that performs cooling through heat exchange with the hot water that is supplied from the solar hot water device.

10 Claims, 12 Drawing Sheets

(56) References Cited

U.S. PATENT DOCUMENTS

| | | | | |
|---|---|---|---|---|
| 2008/0148744 | A1* | 6/2008 | Al-Maaitah | B01D 5/0003 62/98 |
| 2010/0031953 | A1* | 2/2010 | Penev | F24D 17/0021 126/615 |
| 2011/0231176 | A1* | 9/2011 | Sagues | G05B 17/02 703/17 |
| 2012/0132070 | A1 | 5/2012 | Matsuba et al. | |

* cited by examiner

SOLAR DEHUMIDIFYING AND COOLING SYSTEM

CROSS-REFERENCE TO RELATED PATENT APPLICATION

This application claims the benefit of Korean Patent Application No. 10-2013-0169148, filed on Dec. 31, 2013, in the Korean Intellectual Property Office, the disclosure of which is incorporated herein in its entirety by reference.

BACKGROUND OF THE INVENTION

1. Field of the Invention

The present invention relates to a solar dehumidifying and cooling system, and more particularly, to a solar dehumidifying and cooling system including a solar hot water device that produces hot water by using solar heat and a dehumidifying and cooling device that performs cooling through heat exchange with the hot water that is supplied from the solar hot water device.

2. Description of the Related Art

A solar dehumidifying and cooling system including a dehumidifying rotor causes indoor air to have a high temperature and a low humidity while passing through a side of the dehumidifying rotor and causes the indoor air having the high temperature and the low humidity to have a low temperature and a low humidity while passing through a predetermined cooler, and then finally supplies the indoor air having the low temperature and the low humidity to the interior.

A regenerator that operates by receiving external heat is used in order to regenerate the dehumidifying rotor that is included in the solar dehumidifying and cooling system.

The regenerator may be, for example, a device that receives hot water and radiates heat. Accordingly, heat supply is necessary to drive the regenerator, which is related to overall energy efficiency of the solar dehumidifying and cooling system.

Accordingly, when an energy source used to drive the regenerator is replaced with an environment-friendly and economical energy source, overall energy efficiency of the solar dehumidifying and cooling system may be improved.

SUMMARY OF THE INVENTION

The present invention provides a solar dehumidifying and cooling system including a solar hot water device that produces hot water by using solar heat and a dehumidifying and cooling device that performs cooling through heat exchange with the hot water that is supplied from the solar hot water device.

According to an aspect of the present invention, there is provided a solar dehumidifying and cooling system including: a solar hot water device that produces hot water by using solar heat; a hot water supply device that supplies the hot water; and a dehumidifying and cooling device that performs cooling through heat exchange with the hot water that is supplied from the solar hot water device.

The humidifying and cooling device may include: a casing that includes a partition wall formed therein; a first channel and a second channel that are disposed in the casing, are divided by the partition wall, and allow air to flow therein; a dehumidifying rotor that is provided on the partition wall and is disposed to extend over the first channel and the second channel; a regenerator that is disposed to transfer heat to the air in the second channel; and a cooler that cools the air in the first channel, wherein the regenerator transfers the heat of the hot water that is supplied from the solar hot water device to the air in the second channel.

The hot water supply device may further include: an auxiliary heat source that supplies heat to the hot water that is produced by the solar hot water device; and a controller that adjusts the amount of heat that is supplied from the auxiliary heat source by controlling an operation of the auxiliary heat source.

The controller may control the operation of the auxiliary heat source to cause a temperature of the hot water that is supplied to the dehumidifying and cooling device to be equal to or higher than a predetermined temperature.

The solar dehumidifying and cooling system may further include a sensor that measures a temperature or a humidity of external air, wherein the controller controls the operation of the auxiliary heat source to change a temperature of the hot water that is supplied to the dehumidifying and cooling device according to the temperature or the humidify, or information about the temperature and the humidity output from the sensor.

The sensor may include a flow meter, wherein the controller includes a flow rate adjusting device that controls a flow rate of the hot water that is supplied to the regenerator from the solar hot water device, wherein the flow meter transmits information about the flow rate of the hot water to the flow rate adjusting device.

The regenerator may include a heating medium circulation circuit including a heating medium that receives heat through the heat exchange with the hot water that is supplied from the solar hot water device and transfers the heat through heat exchange with the air in the second channel.

According to another aspect of the present invention, there is provided a method of controlling a temperature of hot water that is supplied to a dehumidifying and cooling device, the method including: comparing the temperature of the hot water that is supplied to the dehumidifying and cooling device with a preset temperature; and when the temperature of the hot water is lower than the preset temperature, controlling an operation of an auxiliary heat source to supply heat to the hot water.

The method may further include determining the preset temperature according to a temperature or a humidity of external air.

According to another aspect of the present invention, there is provided a method of controlling a temperature of hot water that is supplied to a dehumidifying and cooling device, the method including: comparing the temperature of the hot water that is supplied to the dehumidifying and cooling device or is retrieved from the dehumidifying and cooling device with a preset temperature; and when the temperature of the hot water is higher than the preset temperature, controlling a flow rate of the hot water that is supplied to the dehumidifying and cooling device.

The method may further include determining the preset temperature according to a temperature or a humidity of external air.

When the temperature of the hot water is higher than the preset temperature, the flow rate of the hot water that is supplied to the dehumidifying and cooling device may be reduced.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Figure 1:
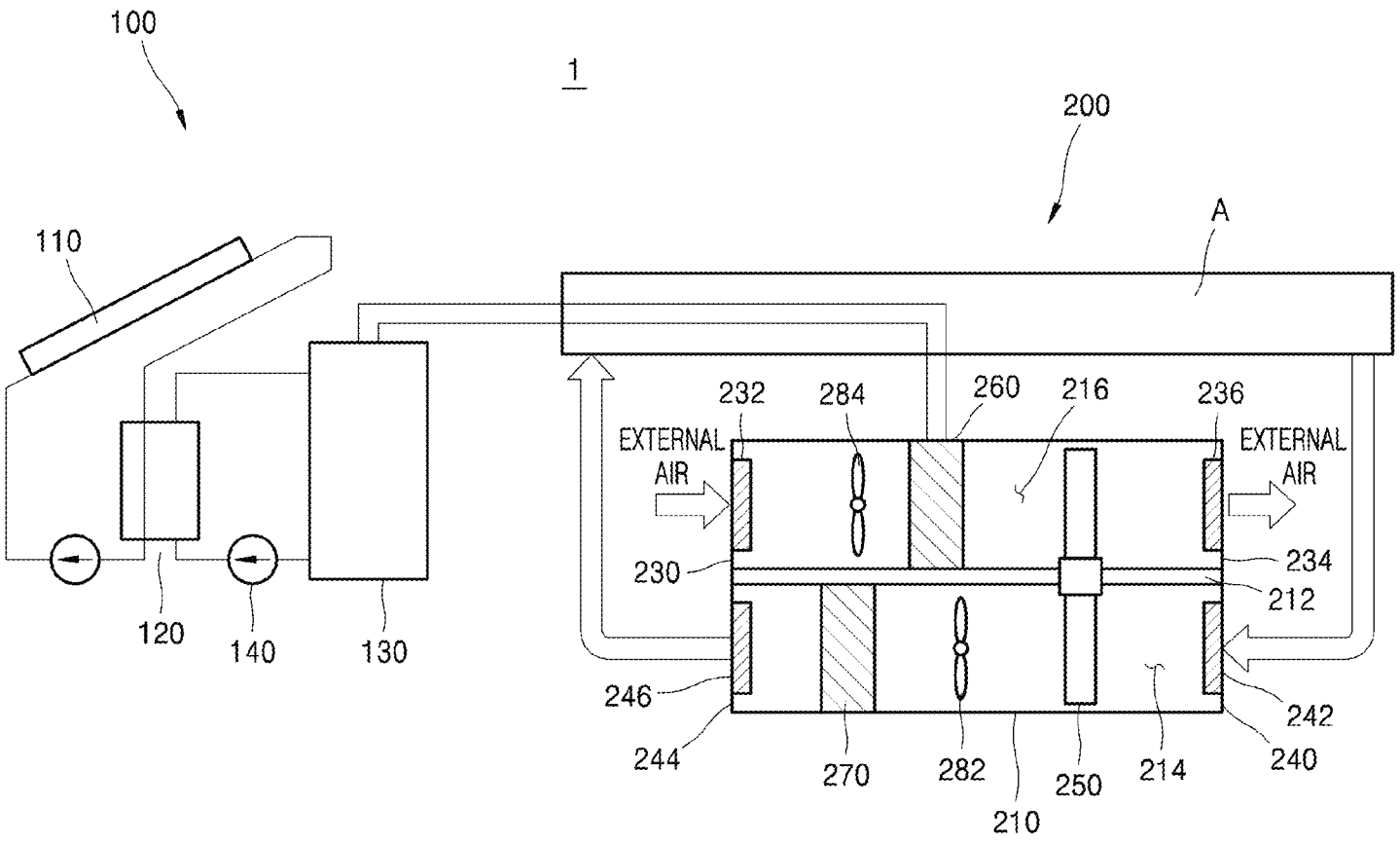
FIG. 1 is a cross-sectional view illustrating a solar dehumidifying and cooling system according to an embodiment of the present invention.

As used herein, the term "and/or" includes any and all combinations of one or more of the associated listed items. Expressions such as "at least one of," when preceding a list of elements, modify the entire list of elements and do not modify the individual elements of the list.

The advantages and features of the present invention and methods of achieving the advantages and features will be described more fully with reference to the accompanying drawings, in which exemplary embodiments of the invention are shown. The invention may, however, be embodied in many different forms and should not be construed as being limited to the embodiments set forth herein; rather these embodiments are provided so that this disclosure will be thorough and complete, and will fully convey the concept of the invention to one of ordinary skill in the art. The same reference numerals denote the same elements throughout.

Meanwhile, the terminology used herein is for the purpose of describing exemplary embodiments only and is not intended to be limiting of exemplary embodiments. As used herein, the singular forms "a", "an" and "the" are intended to include the plural forms as well, unless the context clearly indicates otherwise. It will be further understood that the terms "comprises" and/or "comprising" used herein specify the presence of stated elements, steps, operations, and/or members, but do not preclude the presence or addition of one or more other elements, steps, operations, and/or members.

Unless otherwise defined, all terms (including technical and scientific terms) used herein have the same meaning as commonly understood by one of ordinary skill in the art to which exemplary embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 5:
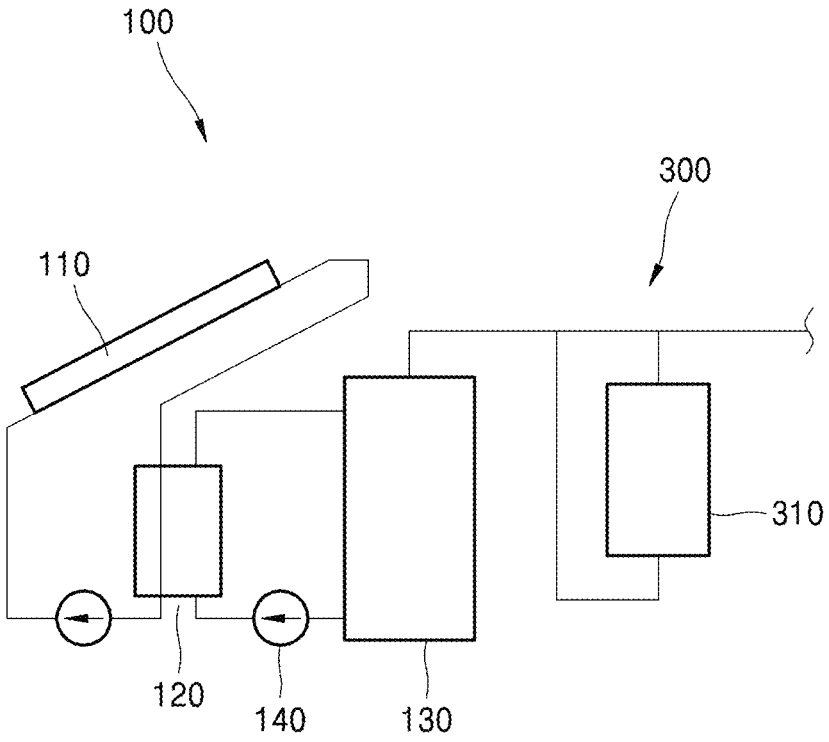
FIG. 5 is a diagram illustrating a structure of an auxiliary heat source of the solar dehumidifying and cooling system, according to an embodiment of the present invention.
Figure 6:
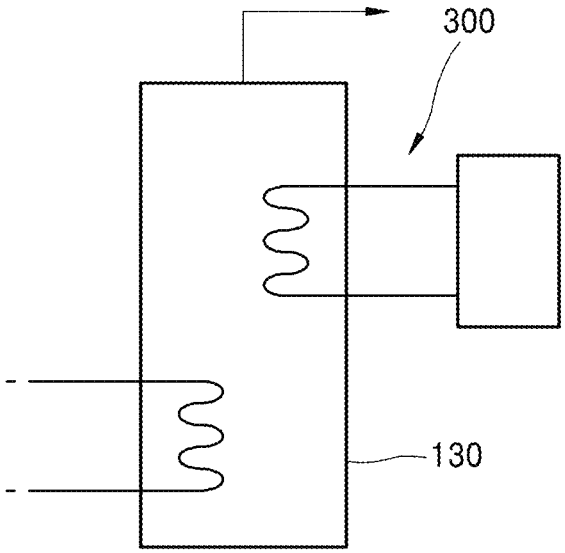
FIG. 6 is a diagram illustrating a structure of the auxiliary heat source of the solar dehumidifying and cooling system, according to another embodiment of the present invention.
Figure 7:
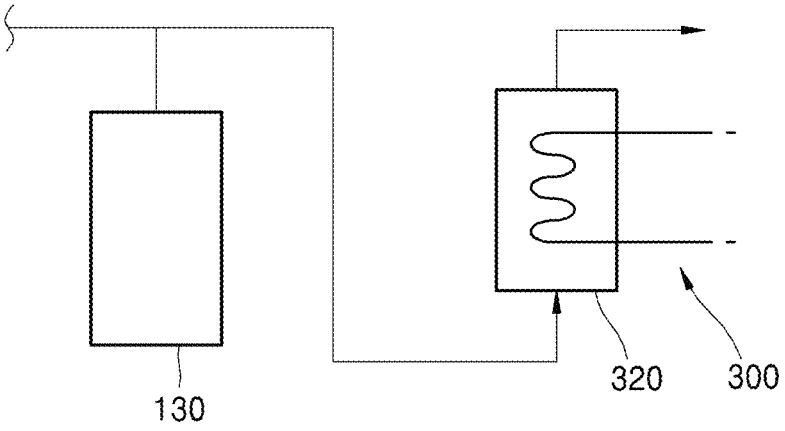
FIG. 7 is a diagram illustrating a structure of the auxiliary heat source of the solar dehumidifying and cooling system, according to another embodiment of the present invention.

FIGS. 1 through 4 are cross-sectional views illustrating a solar dehumidifying and cooling system 1 according to embodiments of the present invention. FIGS. 5 through 7 are cross-sectional views illustrating a structure of an auxiliary heat source 300 of the solar dehumidifying and cooling system 1, according to embodiments of the present invention.

The solar dehumidifying and cooling system 1 includes a solar hot water device 100 that produces hot water by using solar heat and a dehumidifying and cooling device 200 that performs cooling through heat exchange with the hot water that is supplied from the solar hot water device 100.

The solar hot water device 100 produces the hot water by using solar heat.

In detail, the solar hot water device 100 may include a solar collector 110, a heat storage tank 130, and a heat exchanger 120 and a circulation pump 140 that are disposed between the solar collector 110 and the heat storage tank 130.

Solar heat that is collected by the solar collector 110 is supplied by the heat exchanger 120 to the heat storage tank 130. The heat storage tank 130 may include a predetermined tank that may store a predetermined amount of water and helps the solar heat collected by the solar collector 110 to be supplied to the stored water to produce the hot water. In addition, a circulation device for supplying the produced hot water to the dehumidifying and cooling device 200 may be included, and the circulation pump 140 may be provided to perform such a series of processes.

A hot water supply device for supplying the hot water that is produced by the solar hot water device 100 to the dehumidifying and cooling device 200 may be provided. The hot water supply device including an auxiliary heat source 300 and various devices may supply the hot water having a desired temperature to the dehumidifying and cooling device 200 by appropriately adjusting a temperature of the hot water, which will be described below.

The dehumidifying and cooling device 200 that removes a latent heat load by removing moisture in air by using a dehumidifier and performs cooling by using a principle that water evaporation occurs fast in dry air may operate in connection with the solar hot water device 100.

In detail, the dehumidifying and cooling device 200 may include a casing 210 in which a partition wall 212 is provided, a first channel 214 and a second channel 216 that are disposed in the casing 210, are divided by the partition wall 212, and allow air to flow therein, a dehumidifying rotor 250 that is provided on the partition wall 212 and is disposed to extend over the first channel 214 and the second channel 216, a regenerator 260 that is disposed to transfer heat to the air in the second channel 216, and a cooler 270 that cools the air in the first channel 214. The regenerator 260 may be configured to transfer heat of the hot water that is supplied from the solar hot water device 100 to the air in the second channel 216.

The casing 210 may form an outer wall of the dehumidifying and cooling device 200, and may be provided to have therein an inner space in which an air passage is formed and various devices are disposed. The casing 210 may have, but is not limited to, a hollow shape.

The partition wall 212 may be disposed in the casing 210, and the partition wall 212 may divide the inner space of the casing 210 to form at least the first channel 214 and the second channel 216. Both end portions of the first channel 214 and the second channel 216 are open, and thus air may flow through the first channel 214 and the second channel 216. In this case, the first channel 214 may function as a dehumidifying and cooling path through which air in an air-conditioning space A (hereinafter, referred to as air-conditioning air) is introduced to remove moisture and then cooling is performed, and the second channel 216 may function as a regeneration path in which the dehumidifying rotor 250 that absorbs moisture during a dehumidifying and cooling process is dried and regenerated.

An air-conditioning air inlet 240 through which the air-conditioning air is absorbed may be provided at the open end portion of the first channel 214 through which the air-conditioning air is introduced, and an air-conditioning air absorbing filter 242 may be disposed in the air-conditioning inlet 240. The air-conditioning air absorbing filter 242 may filter bacteria and various foreign materials of the introduced air-conditioning air. In addition, an air-conditioning air outlet 244 may be provided at the opposite open end portion of the first channel 214 through which the air-conditioning air is discharged, and an air-conditioning air discharging filter 246 may be disposed in the air-conditioning air outlet 244 to filter bacteria and various foreign materials of the air-conditioning air.

An external air inlet 230 through which external air is absorbed may be provided at the open end portion of the second channel 216 through which the external air is introduced, and an external air absorbing filter 232 may be disposed in the external air inlet 230. The external air absorbing filter 232 may filter bacteria and various foreign materials of the introduced external air. In addition, an external air outlet 234 may be provided at the opposite open end portion of the second channel 216 through which the external air is discharged, and an external air discharging filter 236 may be disposed in the external air outlet 234 to filter bacteria and various foreign materials of the external air.

The dehumidifying rotor 250 is disposed on the partition wall 212, and is rotatably provided. The dehumidifying rotor 250 that is disposed on the partition wall 212 may be disposed to extend over the first channel 214 and the second channel 216.

The dehumidifying rotor 250 may be formed, for example, by applying a chemical such as a dehumidifying agent for absorbing moisture to a roll having a honeycomb shape in order to perform dehumidification. For example, the dehumidifying rotor 250 may include the dehumidifying agent such as silica gel or zeolite that is provided in the dehumidifying rotor 250 and a rotating blade through which air may pass and that is disposed to extend over the first channel 214 and the second channel 216. Preferably, a radius of the rotating blade of the dehumidifying rotor 250 may substantially correspond to a width of each of the first channel 214 and the second channel 216, and thus air that flows through the first channel 214 and the second channel 216 may pass through the dehumidifying rotor 250. The dehumidifying rotor 250 may rotate about a predetermined central axis as described above. For example, the central axis may be connected to the partition wall 212 and the dehumidifying rotor 250 may rotate about the partition wall 212.

As the dehumidifying rotor 250 that is disposed to extend over the first channel 214 and the second channel 216 rotates, partial dry and moisture absorption may be repeatedly performed. That is, assuming that the first channel 214 functions as a dehumidifying and cooling path and the second channel 216 functions as a regeneration path, when a part of the rotating blade of the dehumidifying rotor 250 is located in the first channel 214, the part of the rotating blade of the dehumidifying rotor 250 may absorb moisture of the air-conditioning air, and when the part of the rotating blade of the dehumidifying rotor 250 that has absorbed the moisture of the air-conditioning air moves to the second channel 216, the part of the rotating blade of the dehumidifying rotor 250 may be dried by the external air. Such a process may be repeatedly performed as the dehumidifying rotor 250 rotates.

A predetermined ventilator may be provided in the first channel 214 and the second channel 216 in order to smoothly ventilate the air in the first channel 214 and the second channel 216. In this case, since each of the first channel 214 and the second channel 216 functions as a dehumidifying and cooling path and the second channel 216 functions as a regeneration path, examples of the predetermined ventilator may include an air supply ventilator 282 that is disposed in the first channel 214 and a regeneration ventilator 284 that is disposed in the second channel 216.

The cooler 270 is disposed in the first channel 214 to be close to the air-conditioning air outlet 244. The cooler 270 may cool the air-conditioning air having a high temperature and a low humidity from which the moisture is removed after passing through the dehumidifying rotor 250 and may generate the air-conditioning air having a low temperature and a low humidity.

The cooler 270 may include, for example, a heat exchange rotor. The heat exchange rotor may be formed of a metal having high conductivity, and may help heat exchange between the air that flows through the first channel 214 and the air that flows through the second channel 216. For example, the heat exchange rotor may be rotatably provided on the partition wall 212 and may be disposed to extend over the first channel 214 and the second channel 216, like the dehumidifying rotor 250. For example, the cooler 270 may include, but is not limited to, a predetermined heat pump, instead of the heat exchange rotor.

Preferably, a second cooler (not shown) may be further provided in order to perform additional cooling. The second cooler may generate the air-conditioning air having a temperature desired by a user by additionally cooling the air-conditioning air having the low temperature and the low humidity generated by the cooler 270. The second cooler may be, but is not limited to, an evaporative cooler. For example, when the cooler 270 includes the heat exchange rotor and the air-conditioning air passing through the cooler 270 has a medium temperature and a low humidity, the air-conditioning air passing through the second cooler may having a low temperature and a low humidity due to additional cooling.

The regenerator 260 that transfers heat to the air in the second channel 216 heats the air in the second channel 216. Accordingly, although the regenerator 260 is disposed in the second channel 216 in FIGS. 1 through 4, as long as the regenerator 260 may allow heat exchange with the air in the second channel 216, the regenerator 260 may be disposed, but is not limited to, outside the second channel 216.

As the regenerator 260 heats the air in the second channel 216, a dryness factor of the dehumidifying rotor 250 may be increased to regenerate the dehumidifying rotor 250 and heat strong enough to remove the moisture that is absorbed by the dehumidifying rotor 250 may be supplied.

The heat supplied by the regenerator 260 may be obtained from the hot water that is produced by the solar hot water device 100. That is, the regenerator 260 may include a heat exchanger. The heat exchanger may include a pipe through which a predetermined refrigerant flows and may heat the air in the second channel 216 by using the hot water that is produced by the solar hot water device 100 and flows through the pipe.

Figure 2:
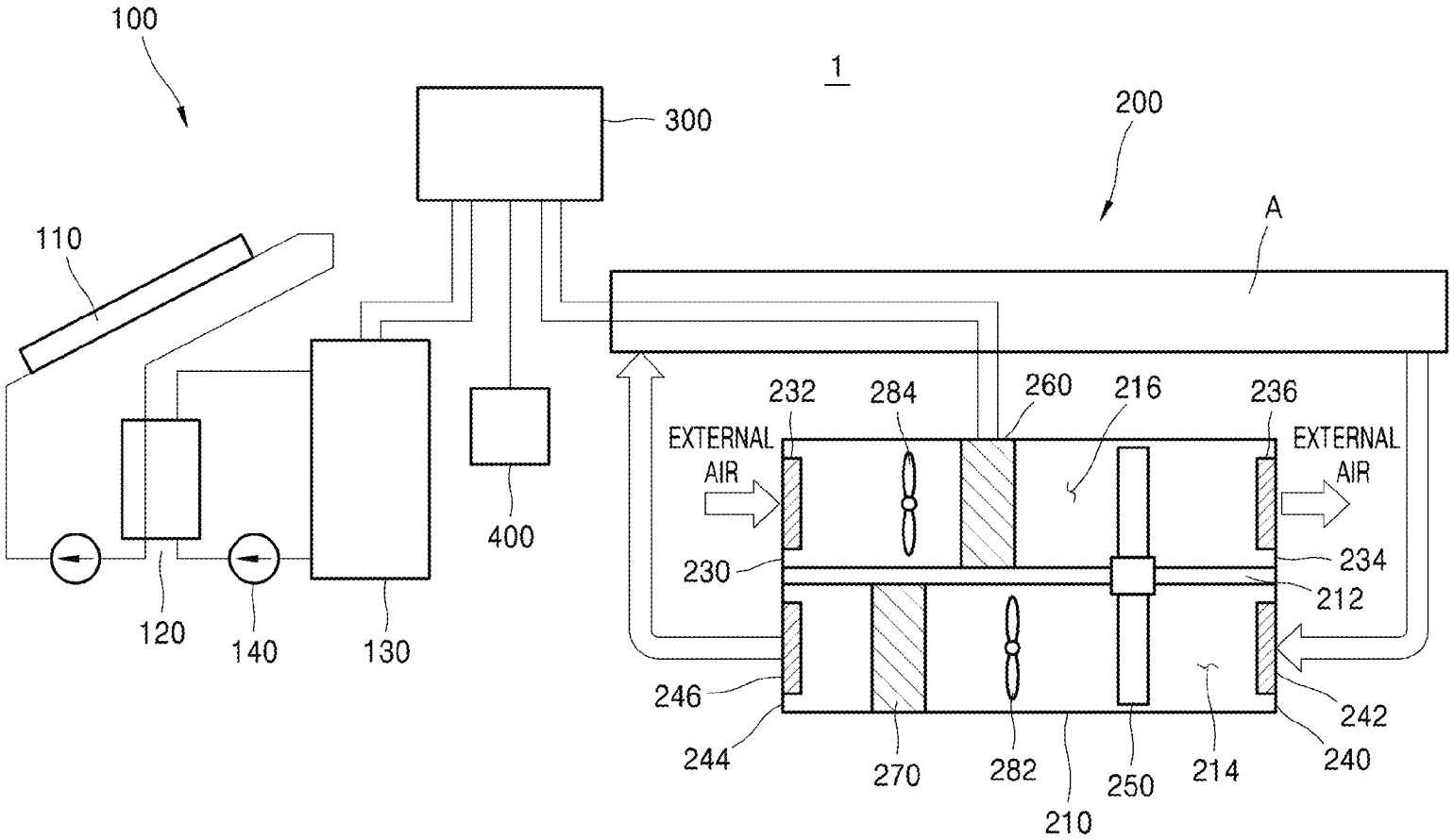
FIG. 2 is a diagram illustrating the solar dehumidifying and cooling system according to another embodiment of the present invention.
Figure 3:
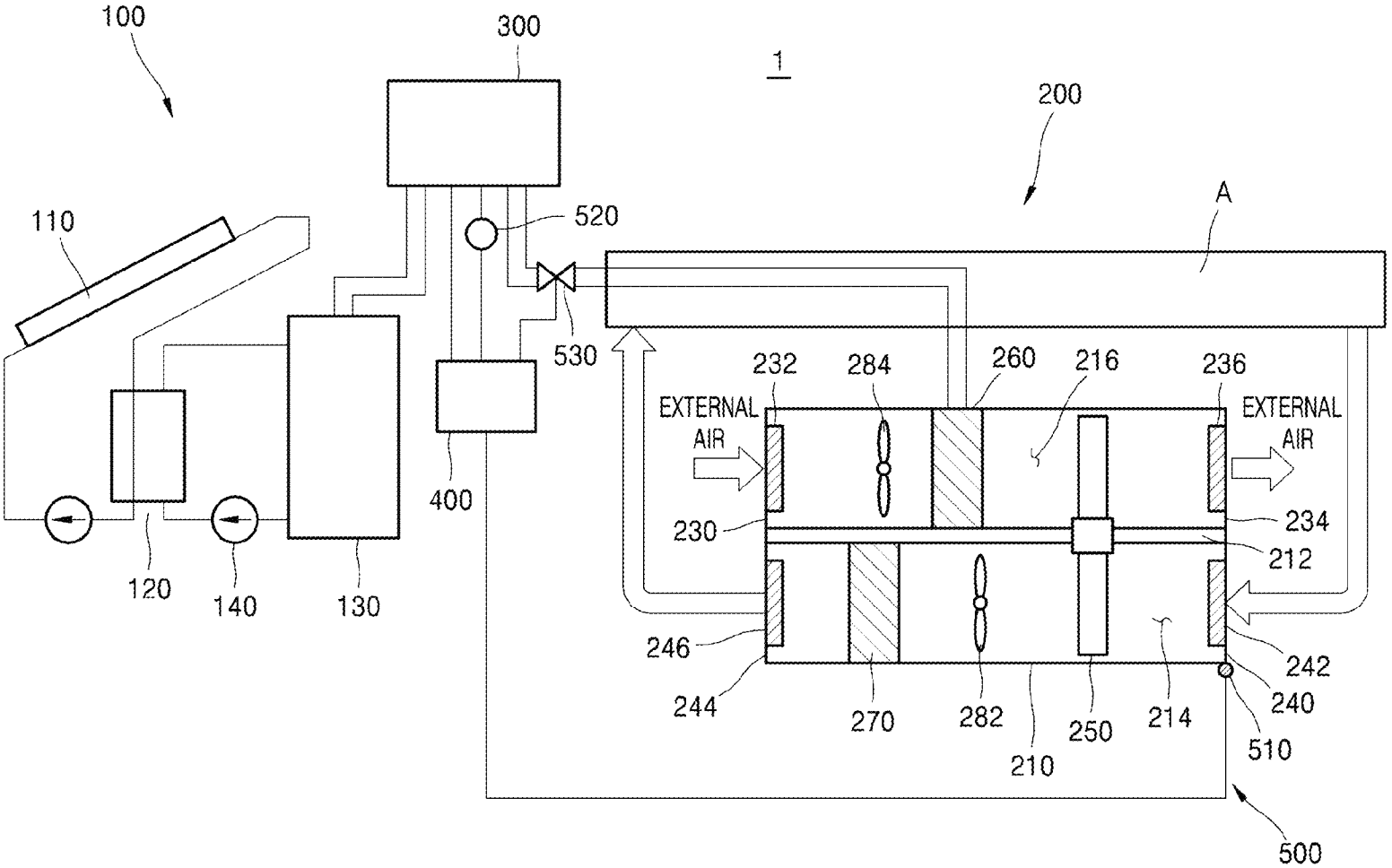
FIG. 3 is a diagram illustrating the solar dehumidifying and cooling system according to another embodiment of the present invention.

As shown in FIGS. 1 through 3, the hot water that is supplied to the regenerator 260 may circulate through the regenerator 260 and then may return to the heat storage tank 130 through a fluid path. In this case, although two fluid paths are illustrated in FIGS. 1 through 3, the present embodiment is not limited thereto.

Figure 4:
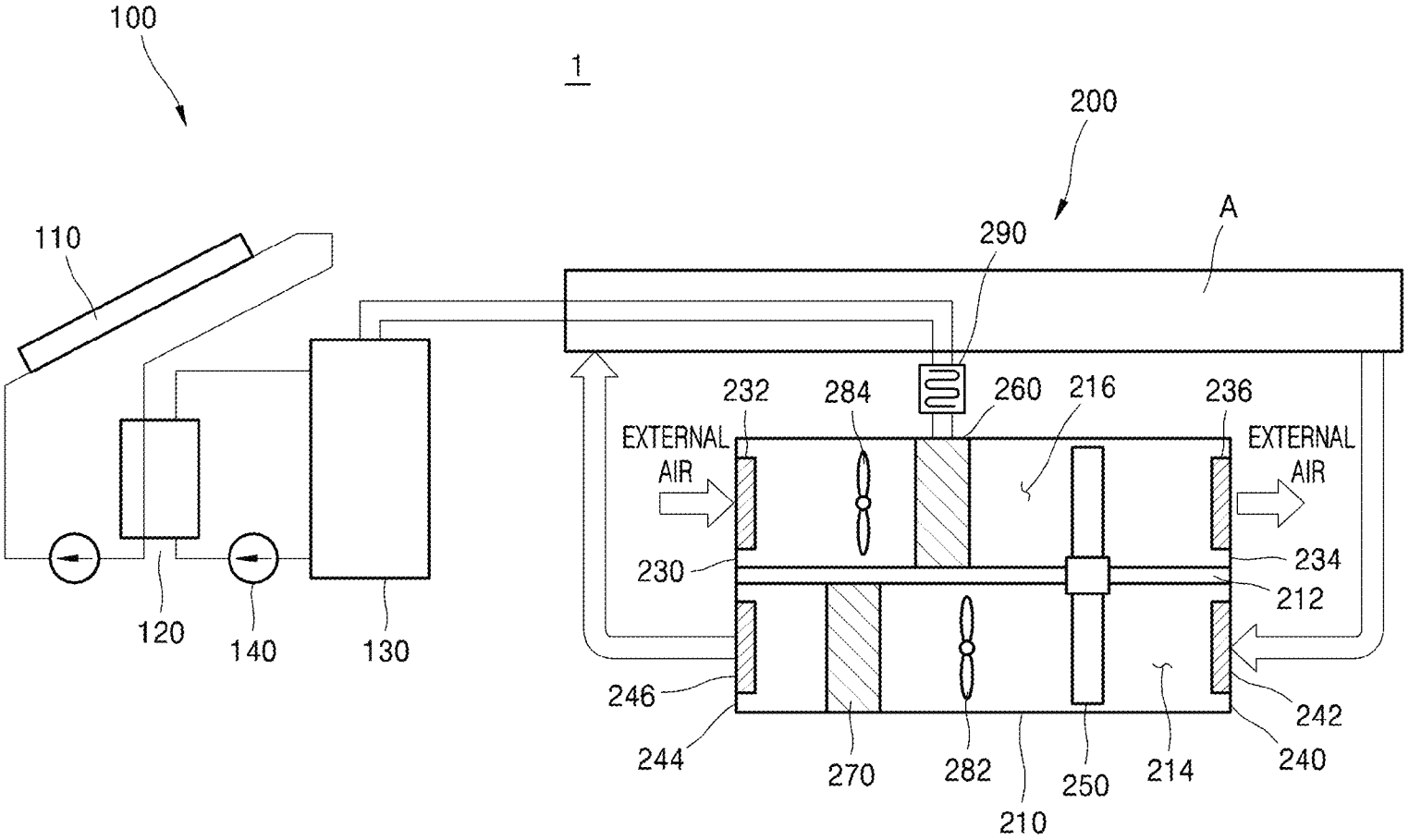
FIG. 4 is a diagram illustrating the solar dehumidifying and cooling system according to another embodiment of the present invention.

Also, preferably, as shown in FIG. 4, the regenerator 260 may include a circulation circuit 290 that uses a heating medium. In this case, the heating medium that circulates through the regenerator 260 undergoes heat exchange with the hot water that is produced by the solar hot water device 100 to supply necessary heat to the regenerator 260. That is, a fluid that circulates in the regenerator 260 may circulate through a circulation path different from that of the hot water that is produced by the solar hot water device 100, and may undergo heat exchange with the hot water. The heating medium may transfer heat through heat exchange with the air in the second channel 216.

Accordingly, heat exchange may occur in the circulation circuit 290, and the circulation circuit 290 may include a predetermined heat exchange device. Accordingly, the performance of the regenerator 260 may be maintained and maintenance and management may be further facilitated irrespective of the amount of the hot water of the solar hot water device 100 or whether the hot water is contaminated.

According to the present embodiments, since the hot water that is produced by the solar hot water device 100 may be used as a heat source of the regenerator 260 that regenerates the dehumidifying rotor 250, thermal energy that is used to supply heat to the regenerator 260 may be reduced. Accordingly, energy efficiency of the dehumidifying and cooling device 200 may be improved and operating costs may be reduced.

Preferably, the solar dehumidifying and cooling system 100 further includes the auxiliary heat source 300 and a controller 400. The auxiliary heat source 300 is configured to supply heat to the hot water that is supplied from the solar hot water device 100 to the regenerator 260, and the controller 400 is configured to adjust the amount of heat that is supplied from the auxiliary heat source 300 by controlling an operation of the auxiliary heat source 300.

The auxiliary heat source 300 is provided to provide additional heat to the hot water that is produced by the solar hot water device 100 and is supplied to the regenerator 260.

In general, a temperature of the hot water that is supplied to the regenerator 260 of the dehumidifying and cooling device 200 ranges from about 40° C. to about 120° C., which are low enough to use solar energy. There is no problem when the amount of solar energy is high and thus a temperature of the hot water of the solar hot water device 100 is sufficiently high whereas there may be a problem when a temperature of the hot water is not sufficiently high. However, according to the present embodiments, such a problem may be avoided by using the auxiliary heat source 300.

In this case, the auxiliary heat source 300 may be, but is not limited to, a predetermined heat device such as a boiler. That is, the auxiliary heat source 300 may have any of various structures such as a structure using electricity or fossil fuel as an energy source or a structure using waste heat of a factory or the like.

The auxiliary heat source 300 and the solar hot water device 100 may have any of various connection structures therebetween. That is, when a temperature of the hot water that is supplied from the solar hot water device 100 is lower than a desired temperature, a boiler 310 that is provided in the auxiliary heat source 300 may instantly heat the hot water and then supply the hot water to the regenerator 260 as shown in FIG. 5, or an upper end portion of the heat storage tank 130 of the solar hot water device 100 may be heated to a desired temperature and then the hot water may be supplied to the regenerator 260 as shown in FIG. 6. Alternatively, a low storage tank 320 may be provided and the low storage tank 320 may heat the hot water all the time to a desired temperature by using the auxiliary heat source 300 as shown in FIG. 7. The present embodiments are not limited thereto, and any of other connection structures may be used.

Accordingly, when a temperature of the hot water that is supplied from the solar hot water device 100 is lower than a preset temperature, the solar dehumidifying and cooling system 1 of the present embodiments may be configured to increase the temperature of the hot water by using the auxiliary heat source 300 and to supply the hot water having a predetermined temperature or more. In this case, it is preferable that the temperature of the hot water is maintained to be equal to or higher than the predetermined temperature. If necessary, the temperature of the hot water may be maintained constant. An optimal temperature of the hot water may be determined by a design variable according to a capacity or the performance of the solar dehumidifying and cooling system 1, and may generally range from, but is not limited to, about 50° C. to about 80° C. which are low temperatures.

An operation of the auxiliary heat source 300 may be controlled by the controller 400.

The controller 400 may maintain constant a temperature of the hot water that is supplied to the regenerator 260 by adjusting the amount of heat that is supplied from the auxiliary heat source 300. In this case, the controller 400 may include a detection device. The detection device may maintain constant a temperature of the hot water by, for example, detecting the temperature of the hot water that is supplied to the regenerator 260 and controlling an operation of the auxiliary heat source 300 according to a desired temperature. Alternatively, the controller 400 may control the hot water to be supplied at the preset temperature or more by measuring a temperature of the hot water that is supplied from the heat storage tank 130 or the auxiliary heat source 300 or by measuring a temperature of the hot water that is retrieved to the heat storage tank 130. Also, when the regenerator 260 has a separate circulation structure through which the heating medium circulates, the controller 400 may be configured to adjust a temperature of the supplied hot water by measuring a temperature of the heating medium that is supplied to the regenerator 260.

According to the present embodiments, since the auxiliary heat source 300 that may maintain constant a temperature of the hot water that is supplied to the regenerator 260 and the controller 400 that controls an operation of the auxiliary heat source 300 are provided, overall operating efficiency of the solar dehumidifying and cooling system 1 may be appropriately maintained.

Preferably, the solar dehumidifying and cooling system 1 further includes a sensor 500 that provides predetermined information to the controller 400, and the controller 400 is configured to control an operation of the auxiliary heat source 300 according to the information that is provided from the sensor 500.

The sensor 500 may be configured to include, for example, a flow meter, a thermometer, or a hydrometer. For example, the sensor 500 may include a thermometer and a hydrometer to collect information about the external air such as a temperature and a humidity of the external air, and may provide the collected information to the controller 400. Also, the sensor 500 may include a flow meter to detect a flow rate of the hot water that is supplied to the regenerator 260 and may provide information about the flow rate to the controller 400.

In the solar dehumidifying and cooling system 1 of the present embodiments, since mixed air of discharged air and the external air is supplied to the interior, both cooling and ventilation may be performed at the same time. However, a temperature and a humidity of the mixed air including the external air may be affected by a temperature and a humidity of the external air, and thus an output of the dehumidifying and cooling device 200 may decrease as the temperature and the humidity of the external air increase.

In order to overcome such a disadvantage, the solar dehumidifying and cooling system 1 of the present embodiments may prevent the performance of the dehumidifying and cooling device 200 from being affected by a change in a temperature and a humidity of the external air by including the auxiliary heat source 300, the controller 400, and the sensor unit 500, and when the temperature and the humidity of the external air are high, by increasing the preset temperature of the hot water that is supplied to the regenerator 260 and supplying the hot water having a higher temperature.

In this case, the sensor 500 may include a temperature sensor and a humidity sensor. The temperature sensor and the humidity sensor may be configured to detect a state of the external air or the air-conditioning air and to provide information about the state of the external or the air-conditioning air to the controller 400.

Also, since the performance of the regenerator 260 is also affected by a flow rate of the hot water that is supplied to the regenerator 260, the controller 400 may appropriately control the flow rate of the hot water that is supplied to the regenerator 260 according to a desired state of the air-conditioning air that is supplied to the air-conditioning space A. In this case, the controller 400 may include a predetermined flow rate adjusting device, for example, a predetermined valve, to adjust the amount of the hot water that is supplied to the regenerator 260.

The sensor 500 may be disposed at an arbitrary position. The sensor 500 may be disposed at an appropriate position according to information to be detected. For example, when the information to be detected is a humidity and a temperature of the external air, the sensor 500 may be disposed adjacent to the external air inlet 230 of the second channel 216 through which the external air is absorbed or adjacent to the external air inlet 240 of the first channel 214, and may accurately detect a state of the external air that is absorbed into the second channel 216. Alternatively, when the information to be detected is a flow rate of the hot water that is supplied to the regenerator 260, a flow meter 530 that detects the flow rate may be disposed on a pipe through which the hot water is supplied to the regenerator 260.

Figure 8:
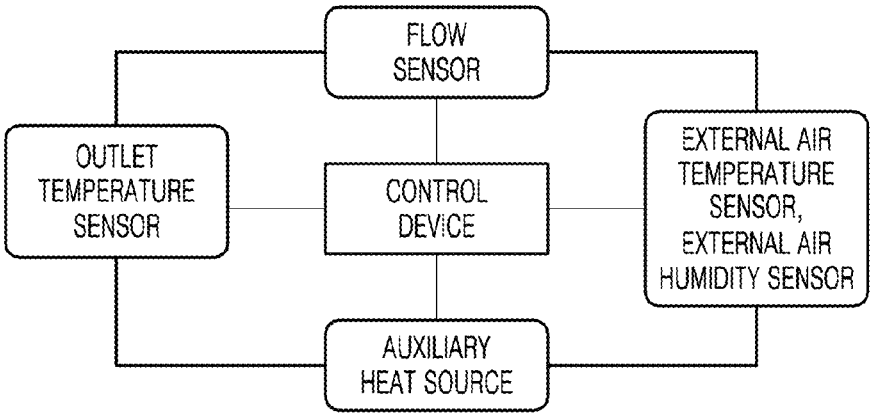
FIG. 8 is a conceptual diagram illustrating a structure of the solar dehumidifying and cooling system, according to an embodiment of the present invention.

FIG. 8 is a conceptual diagram illustrating a structure of the solar dehumidifying and cooling system 1 according to an embodiment of the present invention.

The performance of the solar dehumidifying and cooling system 1 of FIG. 8 may be maintained by adjusting a preset temperature and a flow rate of the hot water that is supplied to the regenerator 260 according to a temperature and a humidity of the external that are measured by the sensor 500. In this case, the sensor 500 may include a flow sensor that measures the flow rate, an external temperature and humidity sensor that measures the temperature and the humidity of the external air, and an outlet temperature sensor that measures a temperature of an outlet through which the air-conditioning air is discharged. Information collected by the sensor 500 is transmitted to the controller 400, and the controller 400 controls an operation of the auxiliary heat source 300 based on the information. For example, the controller 400 determines the preset temperature of the hot water that is supplied to the regenerator 260 according to the temperature and the humidity of the external air, may compare a temperature of the hot water that is supplied to the regenerator 260 with the preset temperature, and when the preset temperature is higher than the temperature of the hot water that is supplied to the regenerator 260, may increase the temperature of the hot water that is supplied to the regenerator 260 by using the auxiliary heat source 300. In contrast, when the preset temperature is lower than or equal to the temperature of the hot water, the auxiliary heat source 300 may not operate and setting of the temperature of the hot water may be adjusted by using the controller 400.

In this structure, a state of the air-conditioning air that is supplied to the air-conditioning space A may be easily maintained according to purpose, and overall cooling efficiency of the solar dehumidifying and cooling system 1 may be improved.

Figure 9:
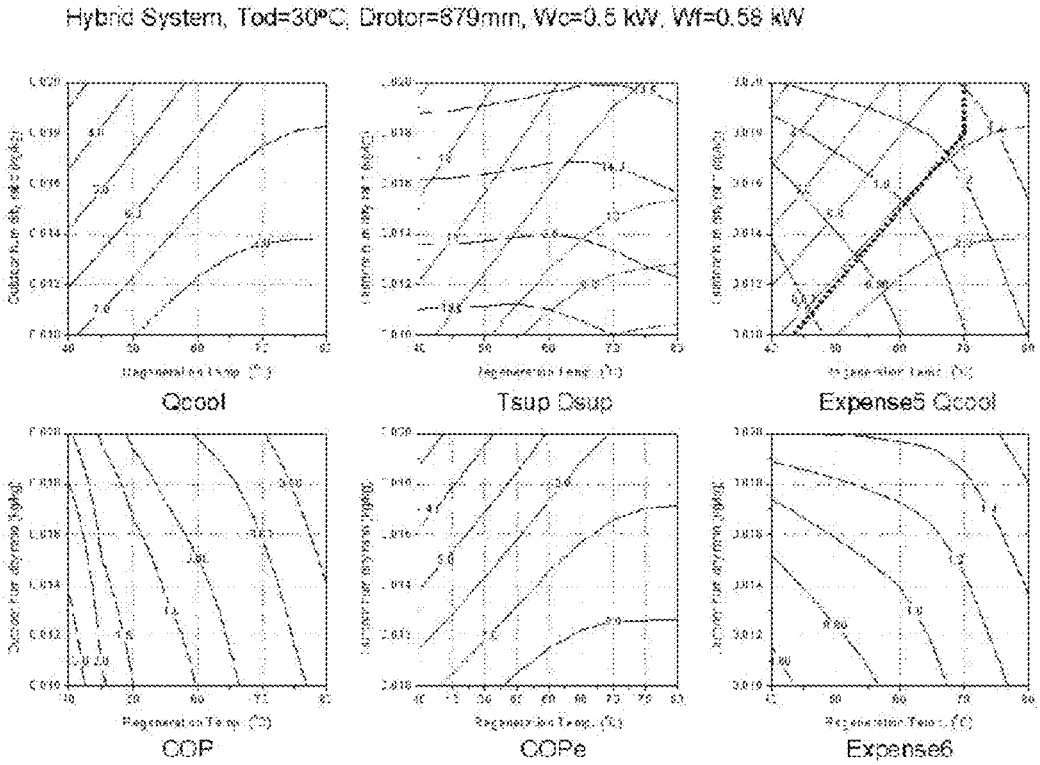
FIG. 9 is a diagram illustrating a relationship between efficiency of the solar dehumidifying and cooling system and a humidity when a temperature of external air is constant, according to an embodiment of the present invention.
Figure 10:
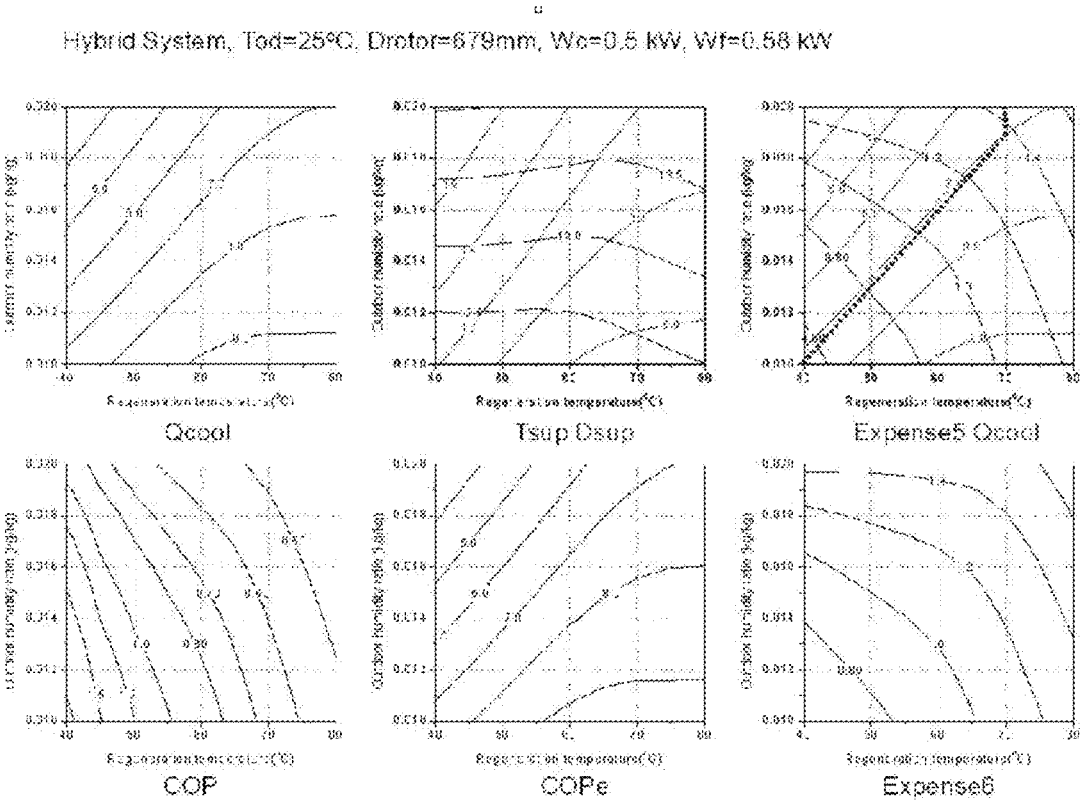
FIG. 10 is a diagram illustrating a relationship between efficiency of the solar dehumidifying and cooling system and a humidity when a temperature of external air is constant, according to an embodiment of the present invention.
Figure 11:
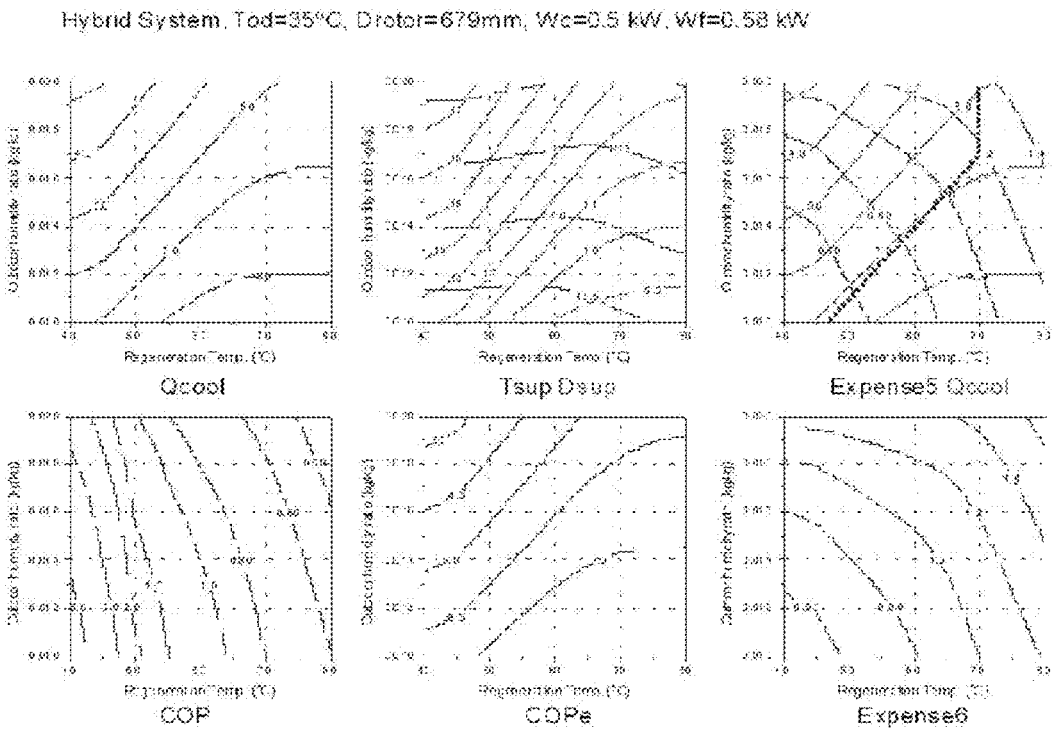
FIG. 11 is a diagram illustrating a relationship between efficiency of the solar dehumidifying and cooling system and a humidity when a temperature of external air is constant, according to another embodiment of the present invention.

FIGS. 9 through 11 are graphs illustrating a relationship between a humidity and efficiency of the solar dehumidifying and cooling system 1 when a temperature of the external air is constant, according to embodiments of the present invention.

FIGS. 9 through 11 illustrate a relationship between a regeneration temperature and a humidity of the external air in terms of a cooling capacity, a performance coefficient, a discharge temperature, a discharge dew point temperature, a performance coefficient based on power consumption, and energy costs per cooling capacity when a temperature of the external air is constant. Since the solar dehumidifying and cooling system 1 of the present embodiments is designed to have a cooling capacity of 7 kW when a regeneration temperature under an ARI condition is 60° C. (a nominal condition), the cooling capacity decreases as the humidity of the external air increases when the regeneration temperature is maintained constant. However, the solar dehumidifying and cooling system 1 may maintain constant the cooling capacity at a nominal cooling capacity or may reduce the amount of reduction by increasing the regeneration temperature.

In FIG. 9 illustrating a case where the temperature of the external air is 30° C., the cooling capacity increases when the regeneration temperature increases, but the amount of increase when the regeneration temperature is equal to or higher than 70° C. or more is reduced. Once the regeneration temperature increases, since the amount of regeneration heat increases, the performance coefficient decreases, and the energy costs per cooling capacity increase, it is preferable to maintain the regeneration temperature at a level that is as low as possible.

A dotted line for the energy costs per cooling capacity of FIG. 9 illustrates a relationship between the humidity of the external air and the regeneration temperature when the cooling capacity is maintained at about 7 kW irrespective of the humidity of the external air. In FIG. 9, the regeneration temperature is controlled to be 60° C. when the humidity of the external air is 0.015 kg/kg and to be 70° C. when the humidity of the external air is 0.018 kg/kg.

As shown in FIG. 10, when the temperature of the external air is 25° C., an overall relationship is similar to that when the temperature of the external air is 30° C., and the cooling capacity is higher than that when the temperature of the external air is 30° C. and the performance coefficient is lower than that when the temperature of the external air is 30° C. for the same humidity of the external air and the same regeneration temperature. Accordingly, for the same humidity of the external air, better efficiency is achieved when the regeneration temperature is adjusted to be a little lower than that when the temperature of the external air is 30° C. Upon examining a relationship between the humidity of the external air and the regeneration temperature in terms of the energy costs per cooling capacity, the regeneration temperature is controlled to be lower by as much as 10/3° C. than that when the temperature of the external air is 30° C., and in this case, the energy costs per cooling capacity for the same humidity of the external air are constant irrespective of the temperature of the external air.

As shown in FIG. 11, an overall relationship when the temperature of the external air is 35° C. is similar to that when the temperature of the external air is 30° C., and the cooling capacity is lower than that when the temperature of the external air is 30° C. and the performance coefficient is higher than that when the temperature of the external air is 30° C. for the same humidity of the external air and the same regeneration temperature. Accordingly, for the same humidity of the external air, better efficiency is achieved when the regeneration temperature is adjusted to be a little higher than that when the temperature of the external air is 30° C. Upon examining a relationship between the humidity of the external air and the regeneration temperature in terms of the energy costs per cooling capacity, the regeneration temperature is controlled to be higher by as much as 10/3° C. than that when the temperature of the external air is 30° C., and in this case, the energy costs per cooling capacity for the same humidity of the external air are constant irrespective to the temperature of the external air.

Figure 12:
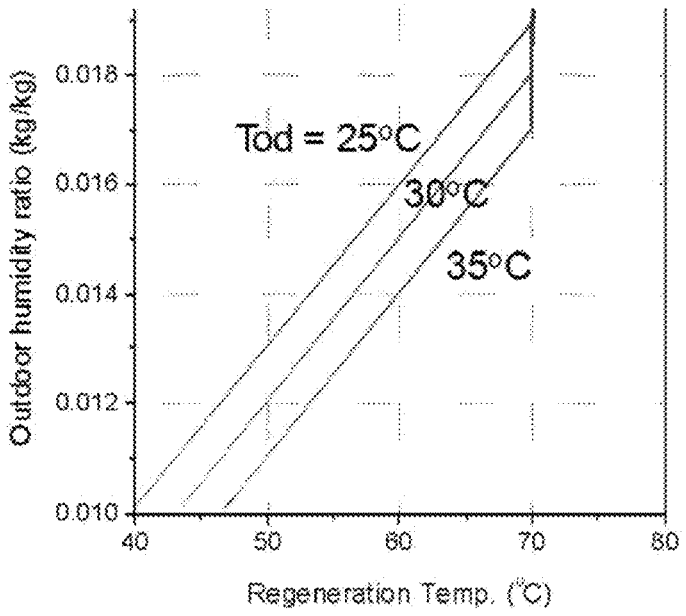
FIG. 12 is a diagram illustrating a relationship between efficiency of the solar dehumidifying and cooling system and a humidity when a temperature of external air is constant, according to another embodiment of the present invention.

FIG. 12 is a view illustrating the regeneration temperature for maintaining constant the cooling capacity and the energy costs per cooling capacity irrespective of a change in the temperature and the humidity of the external air, according to an embodiment of the present invention. Dotted lines of FIGS. 5A, 5B, and 5C are all shown in one graph. When the regeneration temperature is adjusted as shown in FIG. 12 according to a change in the temperature and the humidity of the external air, the cooling capacity and the energy costs per cooling capacity may be maintained almost constant irrespective of the temperature and the humidity of the external air. A method of controlling the regeneration temperature of FIG. 12 is shown as follows.

$$T_{reg} = 50 + \frac{70-50}{0.018-0.012}(w_{od} - 0.012) + \frac{2}{3}(T_{od} - 30)$$

Figure 13:
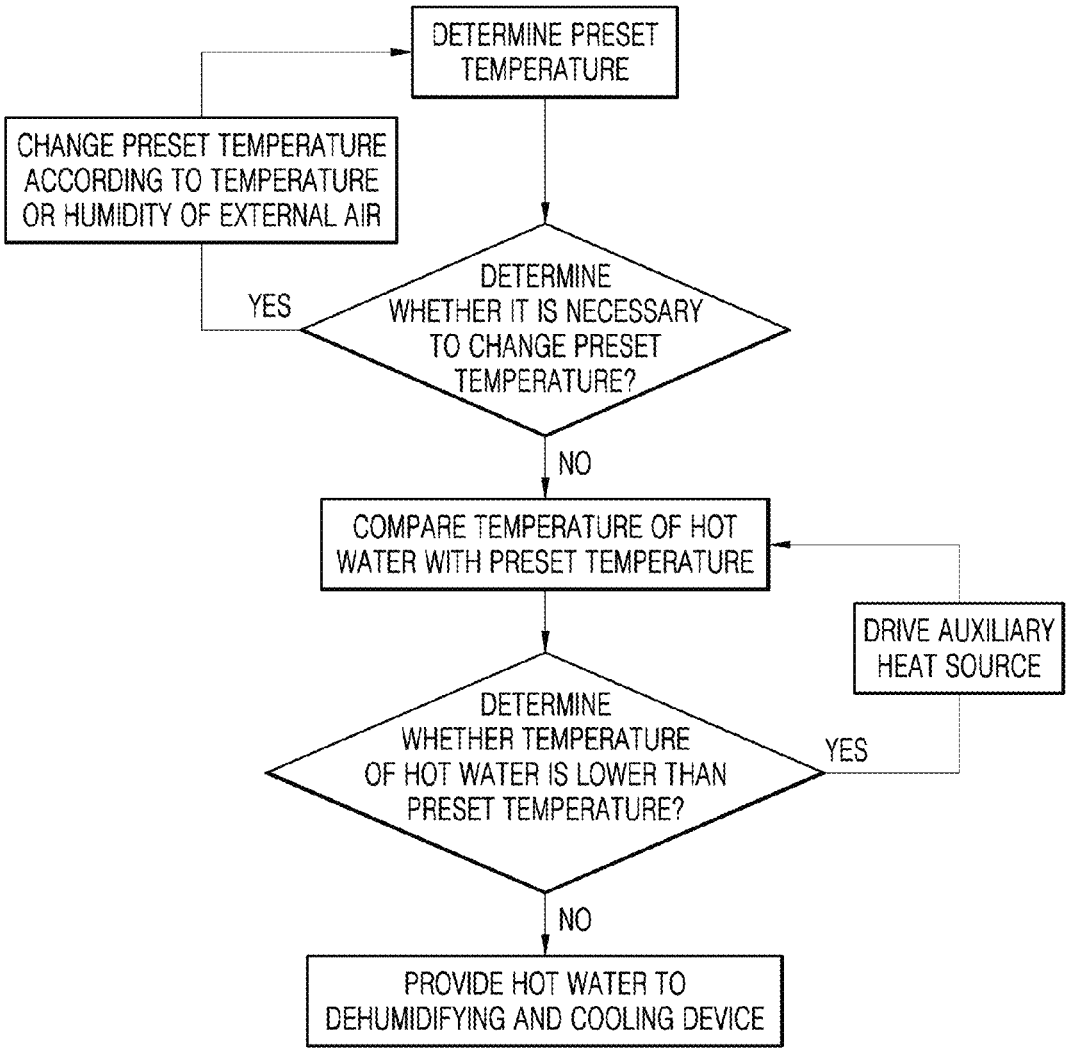
FIG. 13 is a diagram illustrating a regeneration temperature for maintaining constant a cooling capacity and energy costs per cooling capacity irrespective of a change in a temperature and a humidity of external air, according to an embodiment of the present invention.
Figure 14:
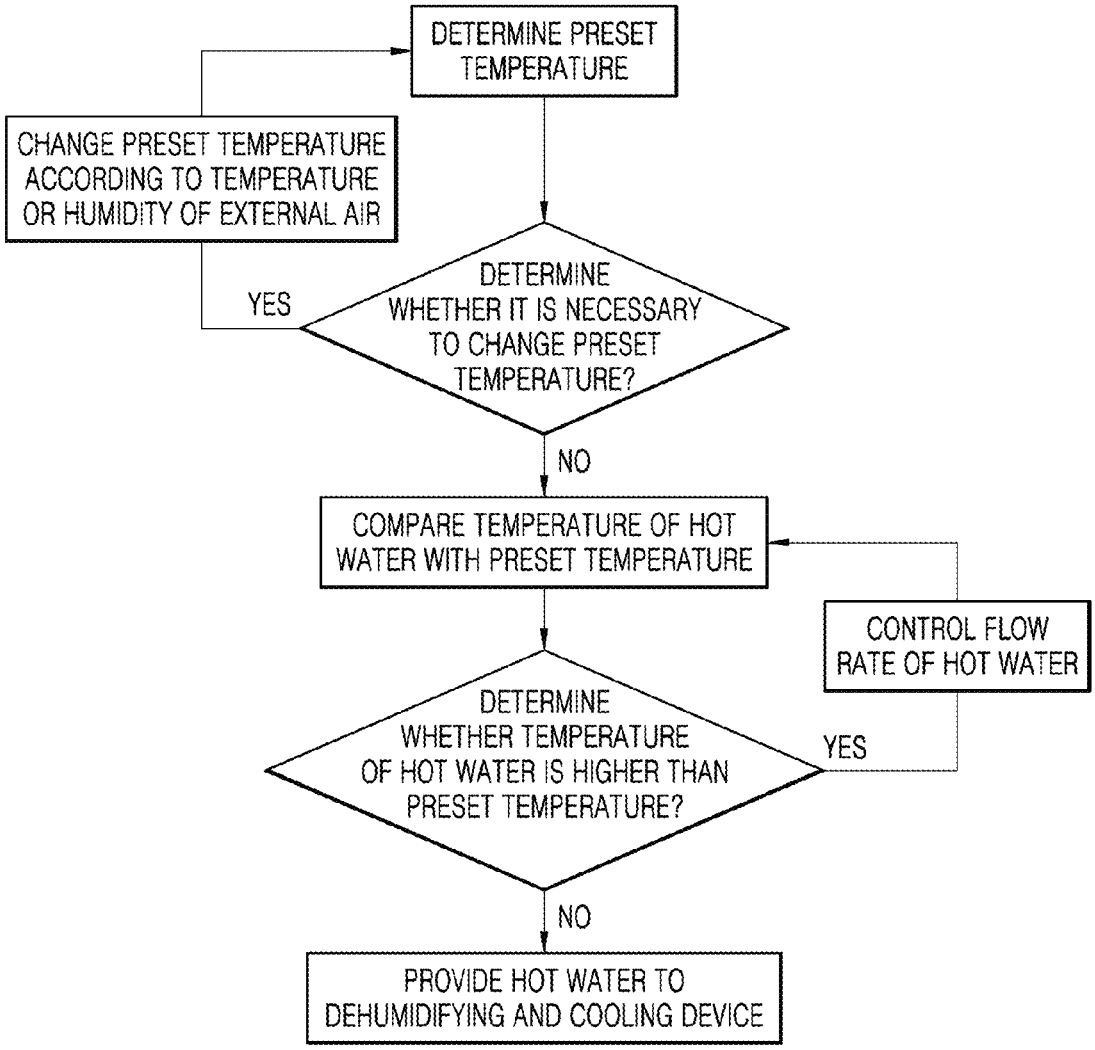
FIG. 14 is a diagram illustrating an operation of controlling a temperature of hot water that is supplied to a dehumidifying and cooling device of the solar dehumidifying and cooling system, according to an embodiment of present invention.

FIGS. 13 and 14 are flowcharts illustrating an operation of controlling a temperature of the hot water that is supplied to the dehumidifying and cooling device 200 of the solar dehumidifying and cooling system 1, according to embodiments of the present invention.

As shown in FIGS. 13 and 14, when the temperature of the hot water that is supplied to the regenerator 260 of the dehumidifying and cooling device 200 is compared with a preset temperature and the temperature of the hot water is lower than the preset temperature, the auxiliary heat source 300 may be driven to heat the hot water and the hot water is supplied to the regenerator 260.

Preferably, when the temperature of the hot water is higher than the preset temperature as shown in FIG. 14, the temperature of the hot water may be reduced by controlling a flow rate of the hot water and the hot water may be supplied to the regenerator 260.

In addition, determining of the preset temperature may be performed before, after, or when the temperature of the hot water is compared with the preset temperature. That is, the preset temperature may vary according to a temperature or a humidity of the external air, and in this case, the preset temperature is changed according to the temperature or the humidity of the external air, and then the changed preset temperature may be compared with the temperature of the hot water. The preset temperature may be set to be high when the temperature and the humidity of the external air are high, and may be set to be low when the temperature and the humidity of the external air are low. As described above, the preset temperature may be adjusted to maintain constant cooling performance.

The determining and the changing of the preset temperature and the comparing of the temperature of the hot water with the preset temperature may be simultaneously performed during an operation of the solar dehumidifying and cooling system 1, and thus there is no limited execution order.

In addition, the driving of the auxiliary heat source 300 according to the temperature of the hot water and the controlling of the flow rate of the hot water are not exclusive each other, and thus both the auxiliary heat source 300 and a flow rate control unit may be provided in one solar dehumidifying and cooling system 1, and thus the flow rate of the hot water may be controlled and the auxiliary heat source 300 may be driven according to the temperature of the hot water. That is, although whether to drive the auxiliary heat source 300 and whether to control the flow rate are separately illustrated in FIGS. 13 and 14, the auxiliary heat source 300 and the flow rate control unit may be provided in one device as is disclosed in the above description of the solar dehumidifying and cooling system 1.

According to a solar dehumidifying and cooling system of the present invention, since hot water that is produced by a solar hot water device may be used as a heat source of a regenerator that regenerates a dehumidifying rotor, thermal energy that is used to supply heat to the regenerator may be reduced. Accordingly, energy efficiency of a dehumidifying and cooling device according to the present invention may be improved and operating costs may be reduced.

Also, since an auxiliary heat source that may maintain constant a temperature of the hot water that is supplied to the regenerator and a controller that controls an operation of the auxiliary heat source are provided, overall operating efficiency of the solar dehumidifying and cooling system may be maintained at an appropriate level.

Preferably, the controller may further include a sensor that provides predetermined information to the controller. The controller is configured to control an operation of the auxiliary heat source according to the predetermined information that is provided from the sensor. Accordingly, since a temperature of the hot water that is supplied to the regenerator increases as a temperature and a humidity of external air increase, the performance of the dehumidifying and cooling device may be prevented from being affected by a change in the temperature and the humidity of the external air.

While the present invention has been particularly shown and described with reference to exemplary embodiments thereof using specific terms, the embodiments and terms have been used to explain the present invention and should not be construed as limiting the scope of the present invention defined by the claims. Accordingly, it will be understood by those of ordinary skill in the art that various changes in form and details may be made therein without departing from the spirit and scope of the present invention as defined by the following claims.

What is claimed is:

1. A solar dehumidifying and cooling system comprising:
- a solar hot water device that produces hot water by using solar heat;
- a hot water supply device coupled to the solar hot water device that supplies hot water;
- a dehumidifying and cooling device that performs cooling through heat exchange with hot water supplied from the hot water supply device;
- an auxiliary heat source coupled to the hot water supply device;
- an external sensor; and
- a controller which is
  - configured to control the auxiliary heat source,
  - configured to adjust a preset temperature of hot water from the hot water supply device in accordance to information from the external sensor corresponding to external air temperature and/or external air humidity, and
  - configured to adjust an amount of hot water to the solar dehumidifying and cooling device.

2. The solar dehumidifying and cooling system of claim 1, wherein the solar humidifying and cooling device comprises:
- a casing that comprises a partition wall formed therein;
- a first channel and a second channel that are disposed in the casing, are divided by the partition wall, and allow air to flow therein;
- a dehumidifying rotor that is provided on the partition wall and is disposed to extend over the first channel and the second channel;
- a regenerator that is disposed to transfer heat to the air in the second channel; and
- a cooler that cools the air in the first channel,
- wherein the regenerator transfers the heat of the hot water that is supplied from the hot water supply device to the air in the second channel.

3. The solar dehumidifying and cooling system of claim 1, wherein
- the controller adjusts an amount of heat that is supplied to the auxiliary heat source.

4. The solar dehumidifying and cooling system of claim 1, further comprising a flow meter coupled to the hot water supply device and coupled to the controller to detect a flow rate of hot water supplied to the regenerator.

5. The solar dehumidifying and cooling system of claim 2, wherein the regenerator comprises a heating medium circulation circuit comprising a heating medium that receives heat through the heat exchange with hot water from the hot water supply device and transfers the heat through heat exchange with the air in the second channel.

6. A method of controlling a temperature of hot water that is supplied to a dehumidifying and cooling device, the method comprising:
- collecting heat at a solar collector;
- exchanging heat from the solar collector into a hot water supply device;
- receiving information at a controller from an external sensor in which the received information corresponds to external air temperature and/or external air humidity from an external sensor;
- adjusting a preset temperature with an auxiliary heat source in accordance to the received information at the controller;
- heating hot water at the hot water supply device in accordance to the adjusted preset temperature; and
- adjusting an amount of hot water flowing to the solar dehumidifying and cooling device.

7. The method of claim 6, wherein when the temperature of the hot water in the hot water supply device is lower than the adjusted preset temperature then the controller controls an auxiliary heat source to increase the temperature of the hot water in the hot water supply device to the adjusted preset temperature.

8. A solar dehumidifying and cooling system comprising:
- a solar collector;
- a heat exchanger coupled to the solar collector;
- a heat storage tank coupled to the heat exchanger;
- an auxiliary heat source coupled to the heat storage tank;
- a dehumidifying and cooling device that comprises:
  - a first channel and a second channel disposed in a casing and divided by a partition wall,
  - wherein the first channel comprises a cooler which dehumidifies and cools air,
  - wherein the second channel comprises a regenerator coupled to the heat storage tank, and a dehumidifying rotor that absorbs moisture from air;
- an external sensor; and
- a controller coupled to the external sensor and coupled to the heat storage tank, wherein the controller is
  - configured to control the auxiliary heat source,
  - configured to adjust a preset temperature of hot water from the heat storage tank in accordance to information from the external sensor corresponding to external air temperature and/or external air humidity, and configured to adjust an amount of hot water to the solar dehumidifying and cooling device from the heat storage tank.

9. The solar dehumidifying and cooling system of claim 8, further comprising a flow meter coupled to the regenerator.

10. The solar dehumidifying and cooling system of claim 8, wherein the cooler is selected from the group consisting of a heat exchange rotor, a heat pump, and an evaporative cooler.

* * * * *